US005318590A

United States Patent [19]

Brennan et al.

[11] Patent Number: 5,318,590

[45] Date of Patent: Jun. 7, 1994

[54] INFANT MASK

[76] Inventors: Timothy E. Brennan, RFD 246A, Atlantic Highlands, N.J. 07716; Henry W. Meahan, 44 4th St., Highlands, N.J. 07732

[21] Appl. No.: 924,427

[22] Filed: Jul. 31, 1992

Related U.S. Application Data

[63] Continuation of Ser. No. 663,187, Feb. 27, 1991, abandoned, which is a continuation of Ser. No. 752,962, Jul. 8, 1985, abandoned.

[51] Int. Cl.[5] ..... A61J 17/00

[52] U.S. Cl. ..... 606/234; 446/27; 606/236

[58] Field of Search ..... 606/234, 236; 446/26, 446/27, 221

[56] References Cited

U.S. PATENT DOCUMENTS

| | | | |
|---|---|---|---|
| D. 269,461 | 6/1983 | Qually | D24/45 |
| D. 269,462 | 6/1983 | Qually | D24/45 |
| 1,214,028 | 1/1917 | Hainert, Jr. | 446/27 |
| 2,203,562 | 6/1940 | Edwards | 446/221 |
| 2,859,552 | 11/1958 | Bornstein | 446/27 |
| 2,860,634 | 11/1958 | Hoover | 128/359 |
| 3,439,447 | 4/1969 | Green | 446/27 |
| 3,964,489 | 6/1976 | Kesselring | 606/236 |
| 4,321,927 | 3/1982 | Lynch | 606/236 |
| 4,554,919 | 11/1985 | Hulbert | 128/359 |
| 4,688,571 | 8/1987 | Tesler | 606/234 |
| 4,715,379 | 12/1987 | McCormick | 606/234 |

FOREIGN PATENT DOCUMENTS

| | | | |
|---|---|---|---|
| 566742 | 1/1945 | United Kingdom | 128/359 |

*Primary Examiner*—John J. Wilson

*Attorney, Agent, or Firm*—Winstead Sechrest & Minick

[57] ABSTRACT

An infant mask is disclosed having contoured features in relief held in place by a nipple inserted in the infant's mouth. In one embodiment, the contoured mask is removably connected to the nipple. In a second embodiment the mask is made to change shapes as a result of pressure applied to the nipple.

10 Claims, 2 Drawing Sheets

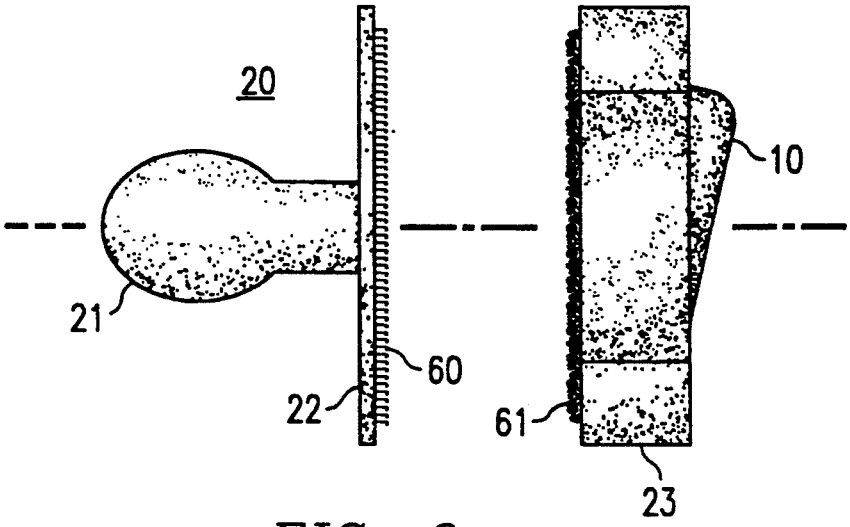
FIG. 6
FIG. 7
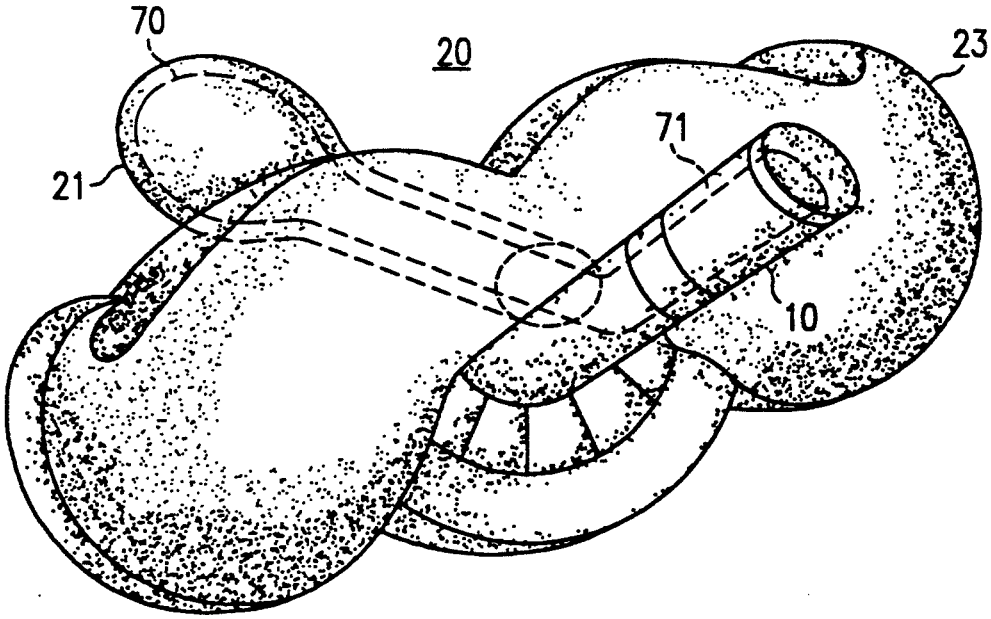

INFANT MASK

RELATED APPLICATIONS

This application is a continuation of application Ser. No. 07/663,187 filed Feb. 27, 1991, which in turn is a continuation of application Ser. No. 06/752,962 filed Jul. 8, 1985, entitled "INFANT MASK" by Timothy E. Brennan and Henry W. Meahan, both now abandoned.

BACKGROUND OF THE INVENTION

This invention relates to a mask and more particularly to a mask to be used for infants.

The use of face masks has a long and interesting history. Children wear them for Halloween and for parties; some cultures wear them for religous purposes; some even use them for medical reasons to chase away evil spirits. Some masks cover the face, others flow into costumes covering the whole front of the body. Mexican Yaqui Indians wear masks on the back of the head at festivals for entertainment. Needless to say that the making of such masks is as varied as the peoples using them and the material used extends from paper mache to alluminum foil.

However, throughout the years a serious problem has continued to exist when it is desired to place a mask on the face of an infant. The problem is one of acknowledged safety. Certainly, placing a mask on the face of an infant is to risk suffocation. Thus, there exists a clear need for a mask which can be used for infants and which does not interfere with the infant's ability to breath properly.

SUMMARY OF THE INVENTION

We have invented a mask which can be used for infants without worry by parents. Our mask, or false face as some would call it, is held in place by the infant's own mouth, much in the manner that the infant sucks on a human nipple. From the infant's prospective the mask becomes nothing more than the nipple it is accustomed to sucking. The action is natural and relaxing. From the parent's prospective, the mask has no more potential for harm than does the placebo nipple now commonly used as a so called pacifier. The infant sucks on the nipple end and the mask covers a least a portion of the infant's face. The sucking action of the infant will cause the mask to move, giving a comic appearance to the infant.

DESCRIPTION OF THE DRAWING

The utilization and construction of our mask will be more apparent from a review of the drawing in which:

FIG. 6 shows the attachment of the nipple to the mask; and

FIG. 7 shows details of the physical appearance change structure.

DETAILED DESCRIPTION

Figure 1:
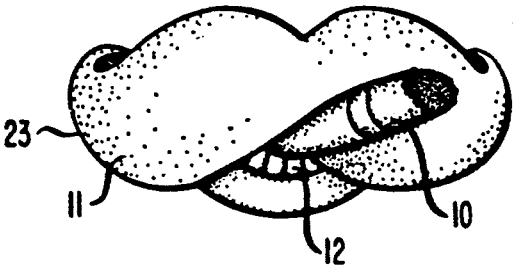
FIG. 1 shows a front view of the mask.

FIG. 1 shows the front view of an infant mask 23 having big contoured lips 11 and a cigar 10 extending from the lips, apparently being held between teeth 12. Mask 23 can be constructed advantageously from moulded plastic complying with appropriate standards from children's toys. Many other materials, such as rubber, PVC, mache, could also be used. The actual dimensions of mask 23 can vary, depending upon the nature of the mask and the age of the infant to which the mask pertains. Typical dimensions would be about 2 inches wide and 1½ inches high.

Figure 2:
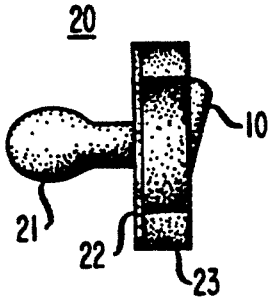
FIG. 2 shows a side view.

As shown in FIG. 2, nipple portion 21 of the mask can be constructed from a common rubber nipple, such as is used on baby bottles. The now well-known nipple pacifier, with a round front plate 22, will serve the purpose well. Mask 23 can be attached to distal end plate 22 by any number of means, such as, by way of example, bonding to form assembly 20. When the two portions are mated the mask portion forms a contour at the front (right most in FIG. 2) of the assembly.

An added feature of assembly 20 is the ability to easily interchange mask faces. This can be accomplished by making mask 23 removably securable to plate 22 by some means, such as the now common hook and loop material, sold under the tradename of Velcro. Using such a method, it is possible to package a number of different mask faces with a single nipple, thereby giving the user greater flexibility. Such an arrangement has the further advantage that the mask can be removed in order to sterilize the nipple, if such becomes necessary. Of course, permanent bonding of the mask to the nipple as well as a unitary construction are acceptable, and in some situations, preferable.

Figure 3:
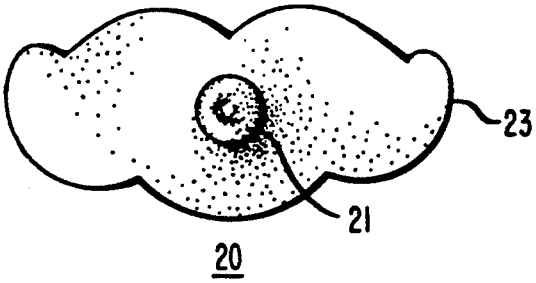
FIG. 3 shows a rear view.

FIG. 3 shows a rear view of assembly 20 with nipple 21 shown attached to mask 23 substantially in the center of the rear surface of the mask.

Figure 4:
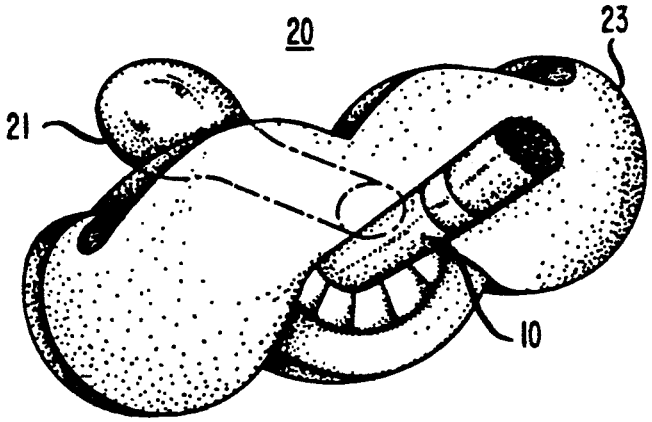
FIG. 4 shows a perspective of the mask.

FIG. 4 is a perspective front view of assembly 20 showing nipple 21 protruding from the rear. It will be seen that in this embodiment the mask is wider, as measured from the centerline of the nipple to a side, than it is tall, as measured from the centerline of the nipple to the top. This is so in order not to interfere with the infant's breathing and to provide a distinctive appearance. Holes may be provided in the mask to facilitate breathing.

Figure 5:
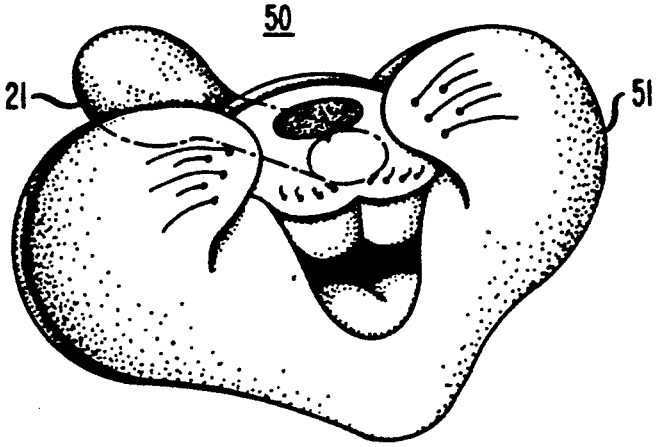
FIG. 5 is the mask having a different face.

FIG. 5 shows a different mask assembly 50 having mask face 51 attached to nipple 21. This is accomplished, as discussed above, by bonding, or releasably securing, mask 51 to plate 22. Plate 22 (as shown in FIG. 2) in turn is bonded or rigidly attached to nipple 21.

FIG. 6 is essentially the same as FIG. 2, except that a hook 60 and loop 61 type detachable connection are shown between elements 22 and 23.

While it has not been shown, our structure could be constructed in a manner such that when the infant applies pressure, as by biting on the nipple, the force thereby created causes some movement in the mask face. Such movement could, for example, be the elongation of the cigar, or the cigarette can be made to appear to glow. Such glowing could be accomplished by having the generated force temporarily modify the physical structure of the cigar. One simple method for accomplishing this change would be to construct the cigar as a hollow tube 70 extending between elements 21 and 10, as shown in FIG. 7. Tube 70 is filled with red material 71 and interconnected with nipple 21 via a small passage through the mask face. As the infant bits on the nipple, material 71 inside the nipple moves away from the infant, forcing, in turn, the read material 71 to move outward via element 70 to the end of the cigar.

Of course, those skilled in the art could find other, perhaps more elegant, means to accomplish this result (even using electrical contacts and lights) all within the scope of our invention. Also, the mask can take many shapes, faces, cartoon characters, and can be made from a vast variety of materials without departing from our invention.

What is claimed is:

1. A face covering assembly comprising a nipple having a proximal end for insertion in a mouth, and a distal end, a second portion having one side shaped to form a mask, said mask having a circumference substantially larger than the circumference of said first portion, and the other side adapted to mate with said distal end of said first portion, and wherein said first portion contains means controlled by pressure applied to said nipple for modifying the appearance of said second portion when said first and second portions are in mated relationship with each other.

2. The invention set forth in claim 1 wherein said shape of said mask side of said second portion is contoured with respect to said other side of said second portion.

3. The invention set forth in claim 1 wherein said first and said second portions are permanently secured to each other.

4. The invention set forth in claim 1 wherein said first and said second portions each contain means for removeably mating said portions.

5. The invention set forth in claim 1 wherein said first and said second portions are of unitary construction.

6. The invention set forth in claim 1 wherein said first and said second portions are permanently bonded to each other.

7. A mask for use on the face of an infant, said mask comprising:

a pliable portion having the shape of the human nipple such that the sucking instinct of an infant in whose mouth said portion is inserted is stimulated;

a mask portion attached at a center attachment point to said pliable portion and having a contoured outer surface, said contoured outer surface having its horizontal dimension larger than its vertical dimension as measured outward from said attachment point, said mask portion having a contoured inner surface substantially flat with respect to said contoured outer surface, and wherein said contoured outer portion forms a caricature of a portion of a face centered with respect to said sucking infant's lips and said attachment point; and means cooperative with said pliable portion for effecting a temporary modification of the physical characteristics of at least one surface of said caricature.

8. A pacifier including a pliable portion for insertion in an infant's mouth;

a portion circumferentially surrounding said pliable portion and larger than said pliable portion, said surrounding portion defining a first physical presentation to a viewer; and means cooperative with said pliable portion and internal thereto for effecting a temporary modification of said first defined physical presentation.

9. The pacifier set forth in claim 8 wherein said surrounding portion is removably associated with said pliable portion.

10. The pacifier set fourth in claim 8 wherein said defined physical presentation is a caricature.

* * * * *